US006171776B1

(12) United States Patent
Ly et al.

(10) Patent No.: US 6,171,776 B1
(45) Date of Patent: Jan. 9, 2001

(54) COLOR PHOTOGRAPHIC SILVER HALIDE MATERIAL

(75) Inventors: Cuong Ly, Köln; Michael Missfeldt, Leichlingen; Heinz-Horst Teitscheid, Köln; Edgar Draber, Odenthal, all of (DE)

(73) Assignee: Agfa N.V. (BE)

( * ) Notice: Under 35 U.S.C. 154(b), the term of this patent shall be extended for 0 days.

(21) Appl. No.: 09/209,404

(22) Filed: Dec. 10, 1998

(30) Foreign Application Priority Data

Dec. 18, 1997 (DE) ..... 197 56 370

(51) Int. Cl.[7] ..... G03C 1/29; G03C 1/16

(52) U.S. Cl. ..... 430/574; 430/505; 430/554; 430/556; 430/558; 430/583; 430/585

(58) Field of Search ..... 430/572, 574, 430/583, 585, 554, 556, 543, 558

(56) References Cited

U.S. PATENT DOCUMENTS

| | | | | |
|---|---|---|---|---|
| 5,512,428 | | 4/1996 | Missfeldt | 430/583 |
| 5,919,613 | * | 6/1999 | Missfedt | 430/583 |
| 5,942,382 | * | 8/1999 | Sinzger et al. | 430/583 |

FOREIGN PATENT DOCUMENTS 197 17 229 10/1998 (DE) .

* cited by examiner

*Primary Examiner*—Thorl Chea
(74) *Attorney, Agent, or Firm*—Connolly Dove Lodge & Hutz LLP

(57) ABSTRACT

A colour photographic silver halide material in which at least one of the blue-sensitive silver halide emulsions is spectrally sensitised with a mixture of at least one seansitising dye of the formula (I) and at least one sensitising dye of the formula (II):

(I)

M in which $R_1$ means an optionally substituted thienyl, pyrroly, indolyl, furamyl or phenyl, (II)

M in which $R_5$, $R_6$, $R_7$, mean H or $R_5$ and $R_6$ together or $R_6$ and $R_7$ together mean the remaining members of a fused benzo ring and the residual substituent means H and $R_2$, $R_3$, $R_4$, $R_8$, $R_9$, $R_{10}$ and M have the meaning stated in the description, is distinguished by elevated sensitivity and improved latent image stabilitity.

11 Claims, No Drawings

COLOR PHOTOGRAPHIC SILVER HALIDE MATERIAL

This invention relates to a colour photographic silver halide material which is distinguished by elevated sensitivity and improved latent image stability.

Exposed colour photographic silver halide material should provide the most consistent sensitometric results possible when processed, irrespective of whether only a few seconds or many months have elapsed between exposure and processing. This property is known as latent image stability.

Prior art colour photographic silver halide materials having at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler still exhibit unsatisfactory results in this respect.

The object of the invention was accordingly to improve latent imale stability. A further object was to improve the sensitivity of the material, in particular the blue sensitivity of an AcCl based material. This may surprisinlly be achieved in the material described above by a mixture of at least one sensitising dye of the formula (I) and at least one sensitising dye of the formula (II).

The present invention accordingly provides a colour photographic silver halide material of the above-stated type which is characterised in that at least one of the blue-sensitive silver halide emulsions is spectrally sensitised with a sensitising dye mixture of the above-stated type:

(I)

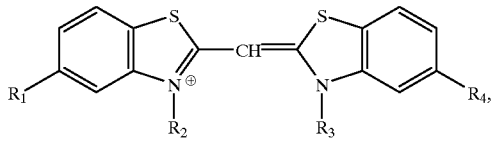

M in which $R_1$ means a substituted or unsubstituted thienyl, substituted or unsubstituted pyrrolyl, substituted or unsubstituted indolyl, substituted or unsubstituted furanyl or substituted or unsubstituted phenyl, $R_2$ and $R_3$ mutually independently mean alkyl, sulfoalkyl, carboxyalkyl, $—(CH_2)_nCON^{\ominus}—COCH_3$, $—(CH_2)_nCON^{\ominus}—SO_2CH_3$, $—(CH_2)_nSO_2N^{\ominus}—COCH_3$, or $—(CH_2)_nSO_2NHSO_2CH_3$, $R_4$ means H, halogen, benzothienyl or $R_1$ and M means a cation or anion required for charge equalisation;

(II)

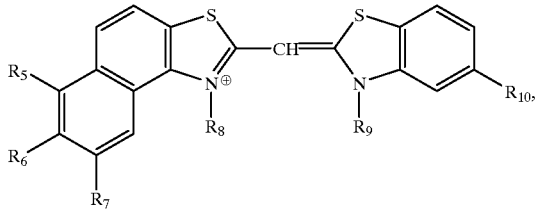

M in which $R_5$, $R^6$, $R_7$, mean H or $R_5$ and $R^6$ together or $R^6$ and $R_7$ together mean the remaining members of a fused benzo ring and the residual substituent means H and $R_8$ and $R_9$ have the same meaning as $R_2$ and $R_3$ $R_{10}$ means substituted or unsubstituted thienyl, substituted or unsubstituted benzothienyl, substituted or unsubstituted pyrrolyl, substituted or unsubstituted indolyl, substituted or unsubstituted furanyl or substituted or unsubstitutecl phenyl and M has the above-stated meaning.

The compounds of the formulae (I) and (II) are preferably used, depending upon the emulsion grain surface area, in a quantity of 0.025 g to 2.5 g per mol of silver halide. Smaller emulsion grains mean a larger grain surface area and the quantity of compounds of the formulae (I) and (II) used must accordingly be increased in order to produce maximum sensitivity.

The mixture ratio of the compounds of the formula (I) to the compounds of the formula (II) (mol/mol) is 1/20 to 20/1. The sensitisation maximum may be shifted in the desired direction by modifying the mixture ratio. The proportion of the longer wave blue sensitiser of the formula (II) should be kept as low as possible in order to improve magenta/yellow colour separation.

Colour photographic silver halide materials having silver halide emulsions consisting of at least 95 mol. % AgCl are preferred, in particular those which contain at most 4 mol. % AgI, preferably less than 0.5 mol. % AgI.

The materials preferably contain at least one yellow coupler of the formula (III)

(III)

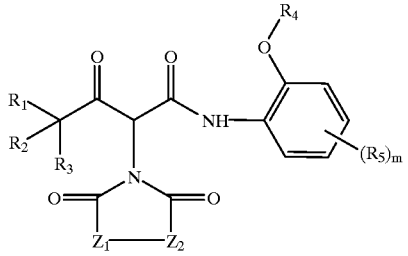

in which $R_1$, $R_2$, $R_3$ mutually independently mean alkyl or $R_2$ and $R_3$ together form a three- to six-membered ring;

$R_4$ means alkyl, cycloalkyl or aryl;

$R_5$ m eans halogen, alkyl, alkoxy, aryloxy, aikoxycarbonyl, alkylsulfonyl, alkylcarbamoyl, arylcarbamoyl, alkylsulfamoyl, arylsulfamoyl;

m means 0, 1, 2, 3;

$Z_1$ means —O—, $—NR_6—$;

$Z_2$ means $—NR_7—$ or $—C(R_8)R_9—$;

$R_6$, $R_7$, $R_8$ and $R_9$ mutually independently mean hydrogen or a substituent.

The emulsions are ripened, on the one hand, with gold compounds and, on the other, with sulfur and/or selenium compounds.

The emulsions according to the invention may be stabilised in a known manner with acidic NH or SH compounds. The stabilisers are preferably added after post-ripening and are selected in such a manner that they do not displace the sensitising dye or sensitising dyes from the emulsion grains of the silver chloride emulsion and moreover do not impede bleaching of the image silver during processing.

Ripening with sulfur preferaby proceeds with sodium thiosulfate as the ripening agent, but thioureas or isothiocyanates or thiophosphates may also be used as sulfur ripening agents.

Ripening with selenium preferably proceeds with selenoureas which are at least trisubstituted, with heterocyclic selenones, which cannot be deprotonated to yield a selenolate ion, or with phosphane selenides, preferably with triarylphosphane selenides.

Ripening with gold preferably proceeds with gold(III) chloride or a tetrachloroaurate(III) salt, which is reduced to a gold(I) compound during the course of ripening.

Sulfur and/or selenium ripening, on the one hand, and gold ripening, on the other, may proceed simultaneously or in succession.

The emulsions may additionally also be doped with other transitional metal compounds of group VIII and/or of groups IB and IIB of the periodic system, which are added during or after precipitation of the silver chloride in order to establish the desired gradation or a desired development behaviour largely without reciprocity failure. This concerns, for example, salts of rhodium(III) or iridium(IV). The emulsions may also be doped with hexacyanoferrate(II).

The emulsions may additionally also contain palladium (II) or lead(II) compounds, in particular tetrachloropalladates(II), which are intended to improve long term stability.

In order to reduce fog, the emulsions may furthermore contain certain isothiazolone or isoselenazolone compounds, or disulfides or diselenides.

Chemical ripening by sulfur or selenium compounds and gold and spectral sensitisation may be performed separately or in a single stage. The sensitising dyes are preferably added immediately on completion of crystal formation before chemical ripening.

Particularly preferred colour photographic silver halide materials are those which contain pyrazolotriazole magenta couplers of the formula (IV) as the magenta coupler (IV)

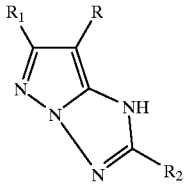

in which

R means H or a group which is eliminated under chromogenic development conditions, $R_1$ means optionally substituted alkyl, $R_2$ means $R_1$ or aryl, wherein the sum of all the C atoms of residues $R_1$ and $R_2$ in a coupler molecule is at least 12.

The colour photographic silver halide material is preferably a print material.

The photographic print materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285.

The colour photographic print materials conventionally contain at least one redsensitive, one green-sensitive and one blue-sensitive silver halide emulsion layer optionally together with interlayers and protective layers.

Depending upon the type of the photographic material, these layers may be differently arranged. This is demonstrated with colour negative paper:

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The substantial constituents of the photographic emulsion layers are the binder, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89.

Details relating to colour couplers may be found in *Research Disclosure* 37254, part 4 (1995), page 288 and in *Research Disclosure* 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 mm in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain UV light absorbing compounds, optical brighteners, spacers, filter dyes, formalin scavengers, light stabilisers, anti-oxidants, $D_{min}$ dyes, additives to improve stabilisation of dyes, couplers and whites and to reduce colour fogging, plasticisers (lattices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq..

The layers of colour photographic materials are conventionally hardened, i.e. the binder used, preferably gelatine, is crosslinked by appropriate chemical methods.

Instant or rapid hardeners are preferably used, wherein instant or rapid hardeners are taken to mean those compounds which crosslink gelatine in such a manner that immediately after casting, at the latest some days after casting, hardening is concluded to such an extent that there is no further change in sensitometry and swelling of the layer structure determined by the crosslinking reaction. Swelling is taken to mean the difference between the wet layer thickness and dry layer thickness during aqueous processing of the material.

Suitable instant and rapid hardeners may be found in *Research Disclosure* 37254, part 9 (1995), page 294 and in *Research Disclosure* 37038, part XII (1995), page 86.

Once exposed with an image, colour photographic materials are processed using different processes depending upon their nature. Details relating to processing methods and the necessary chemicals are disclosed in *Research Disclosure* 37254, part 10 (1995), page 294 and in *Research Disclosure* 37038, parts XVI to XXIII (1995), pages 95 et seq. together with example materials.

Examples of couplers of the formula (IV) are:

M-1

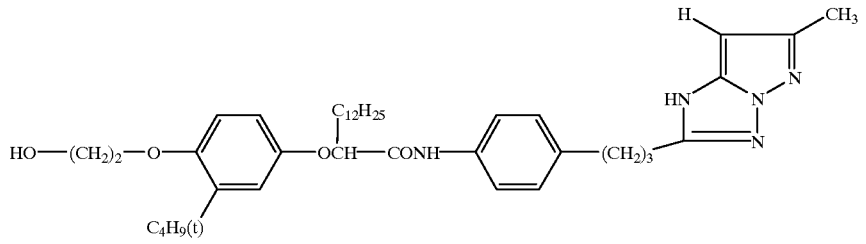

M-2

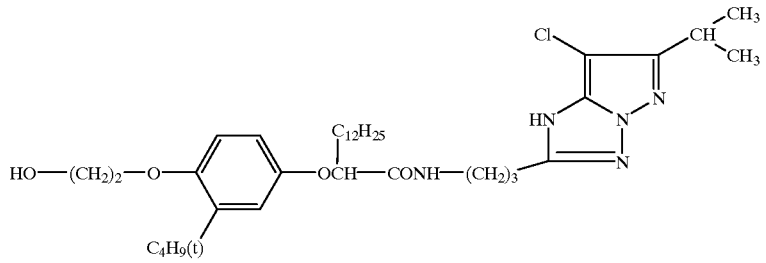

M-3

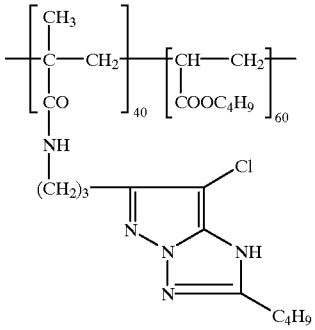

M-4

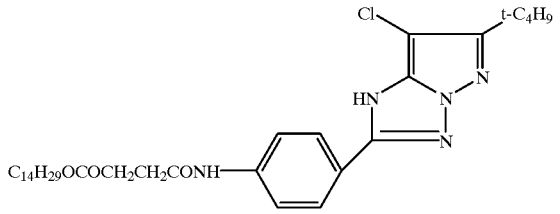

M-5

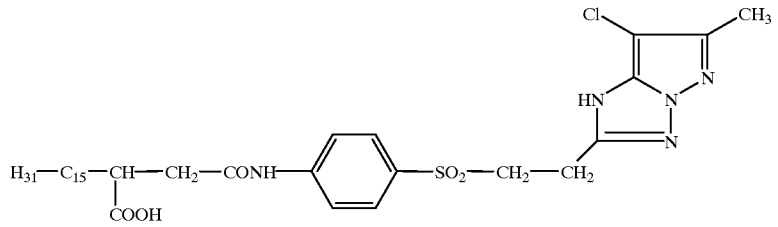

M-6

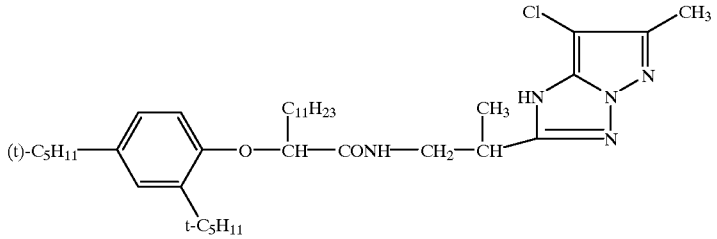

-continued
M-7
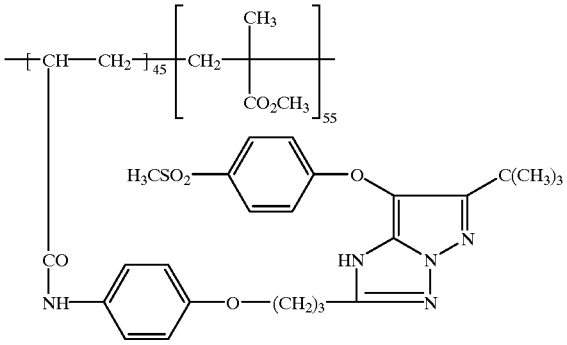
M-8
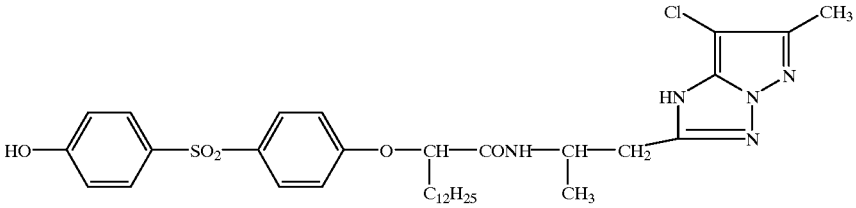
M-9
M-10
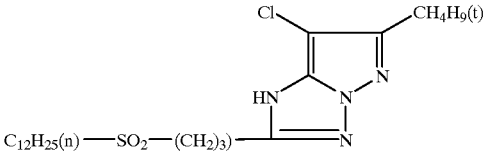
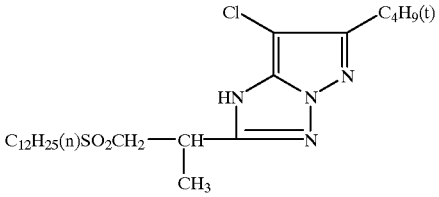
M-11
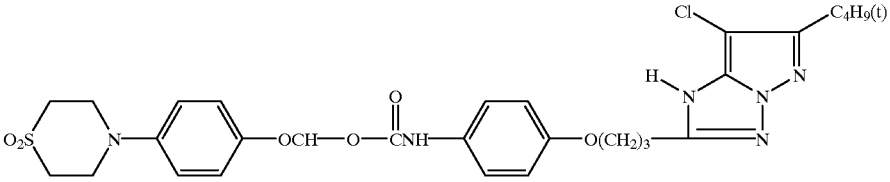
M-12
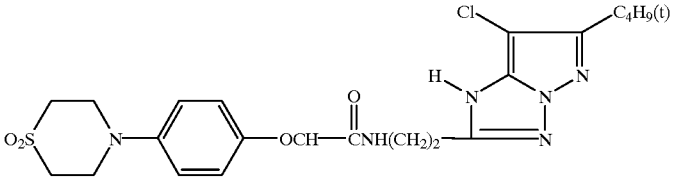
M-13
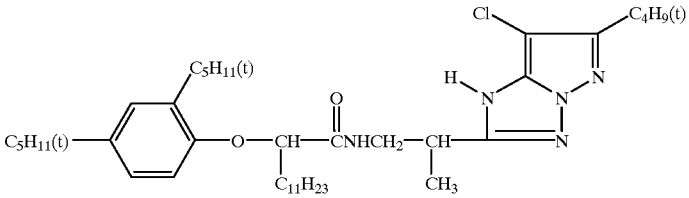

Suitable sensitising dyes of the formulae (I) and (II) are, for example:
I-1
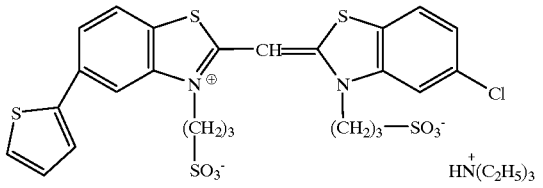
I-2
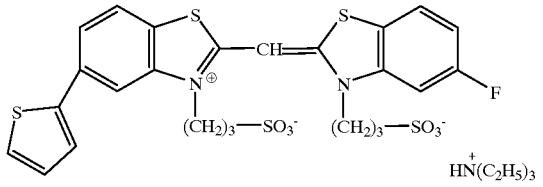
I-3
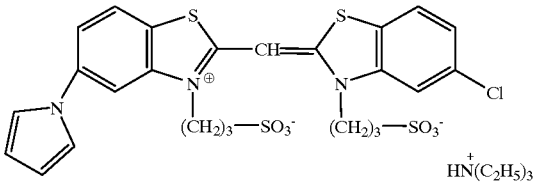
I-4
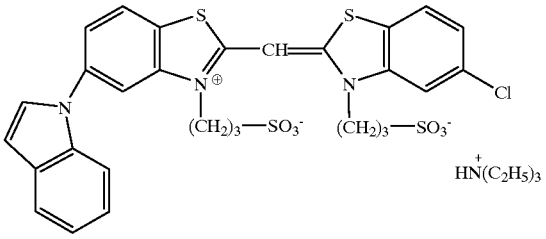
I-5
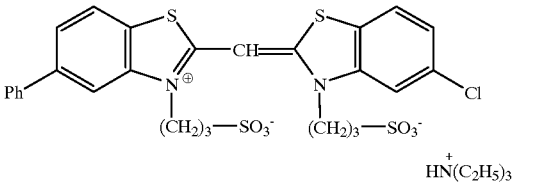
I-6
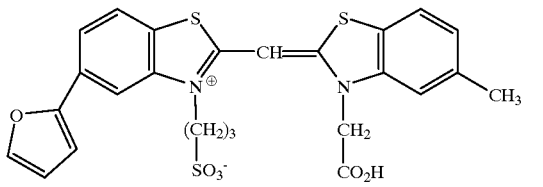
-continued
I-7
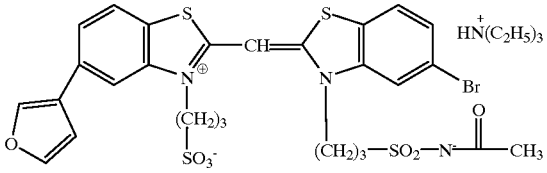
I-8
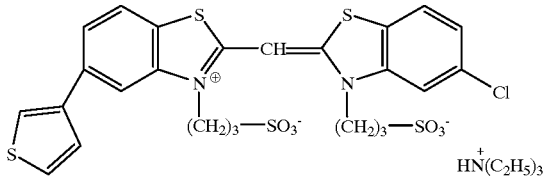
I-9
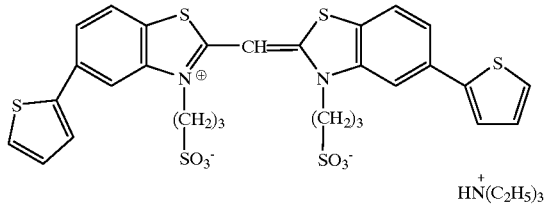
II-1
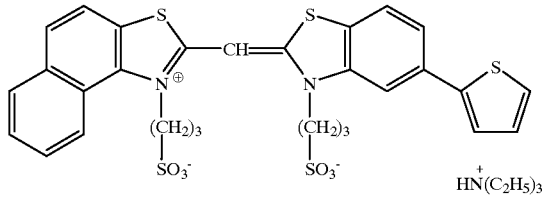
II-2
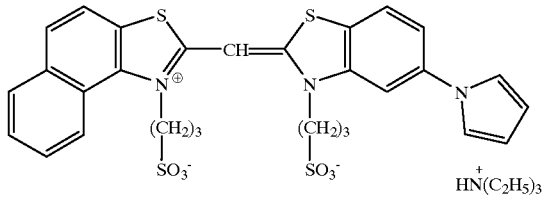
II-3
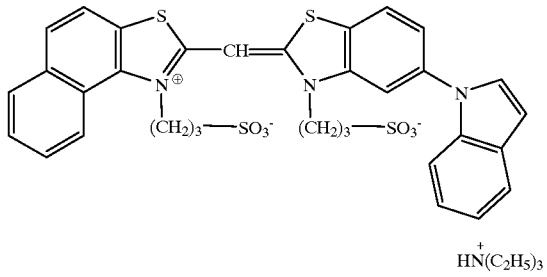

-continued
II-4
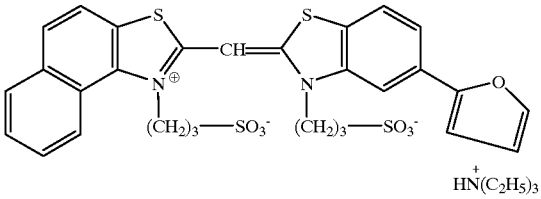
II-5
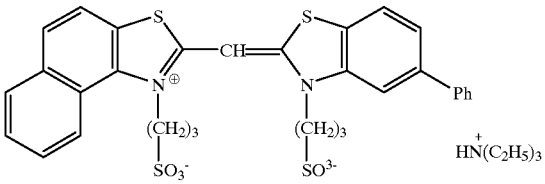
II-6
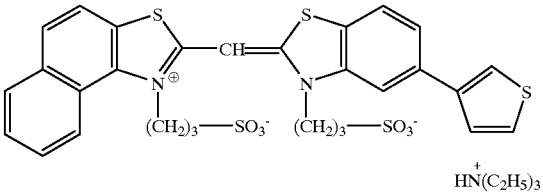
II-7
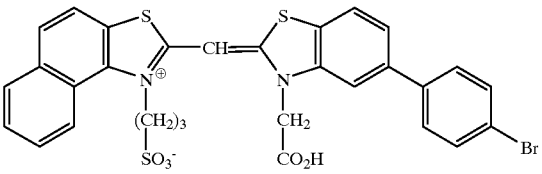
II-8
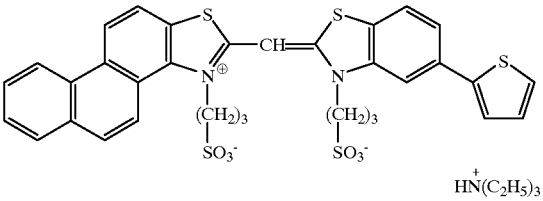
-continued
II-9
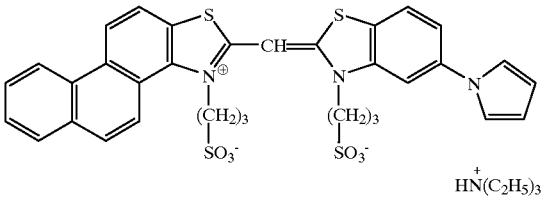
II-10
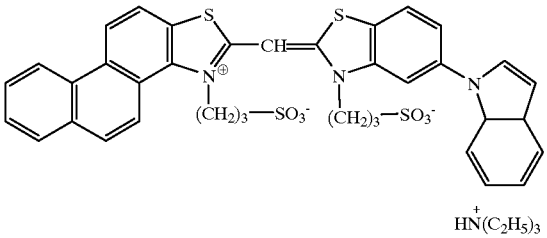
II-11
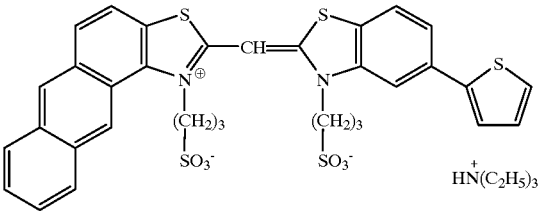
II-12
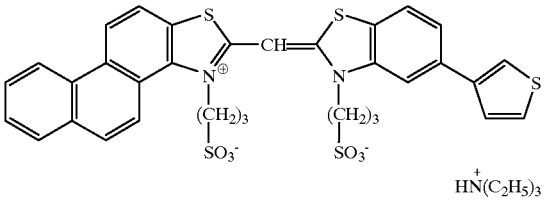
Examples of yellow couplers of the formula (III) according to the invention are:

Y-1
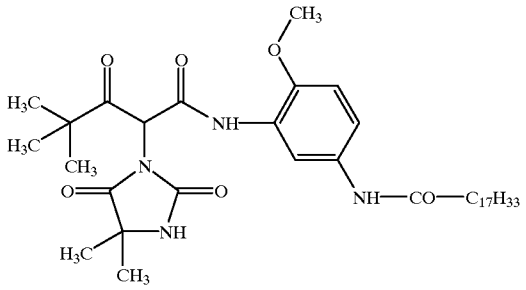
Y-2
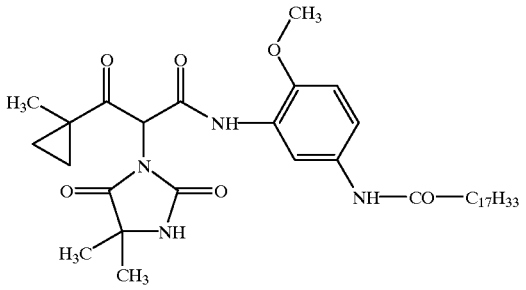
Y-3
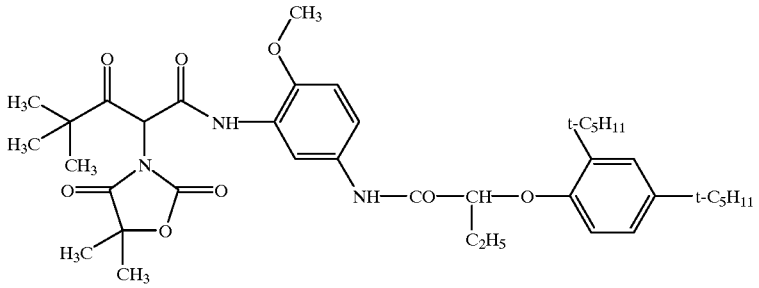
Y-4
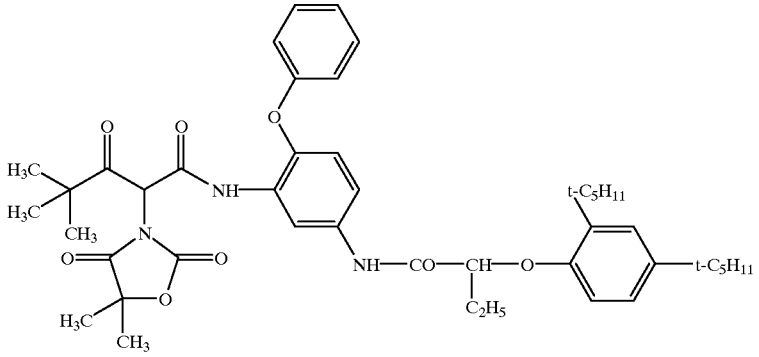
Y-5
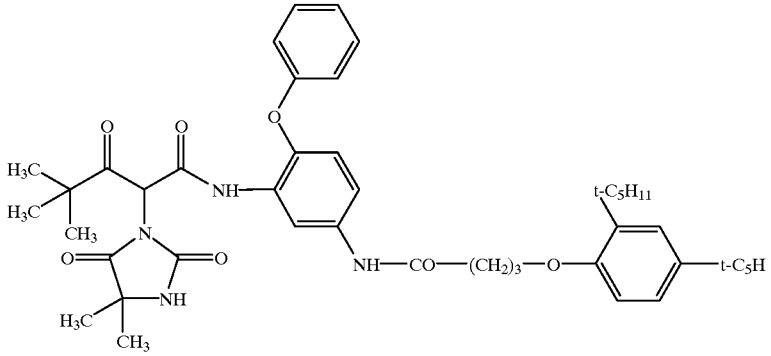

-continued
Y-6
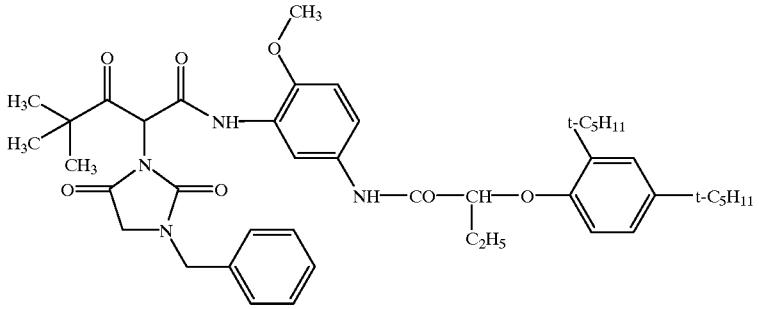
Y-7
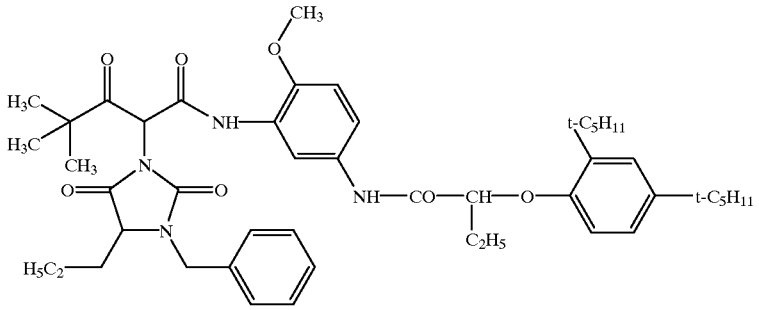
Y-8
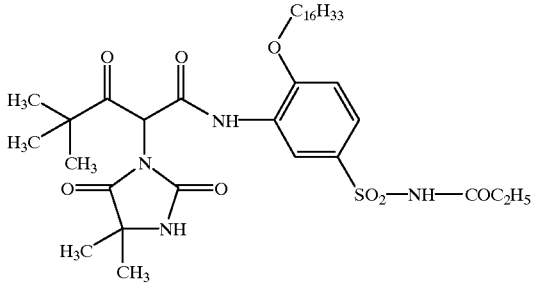
Y-9
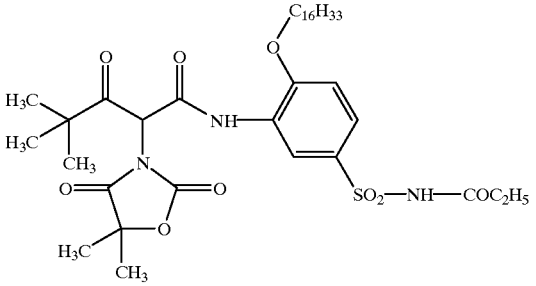
Y-10
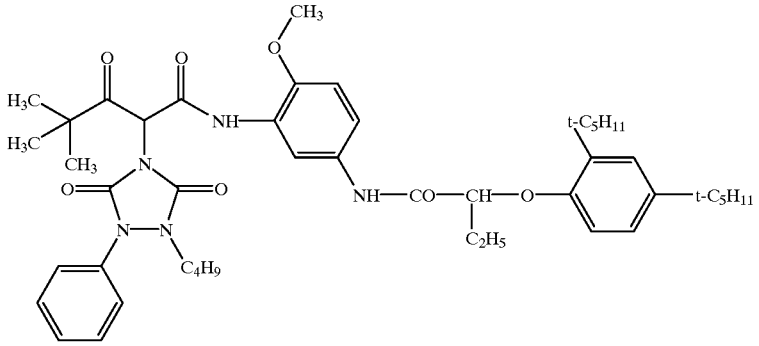

-continued
Y-11
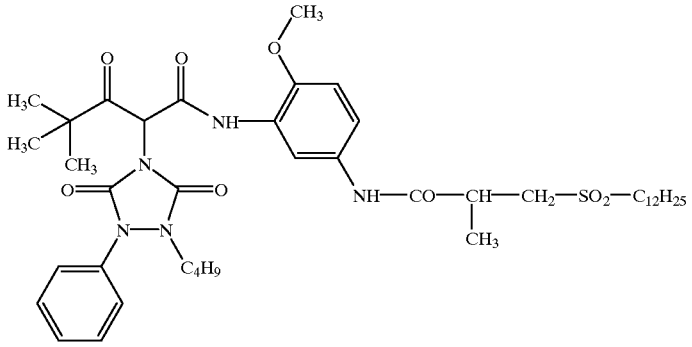
Y-12
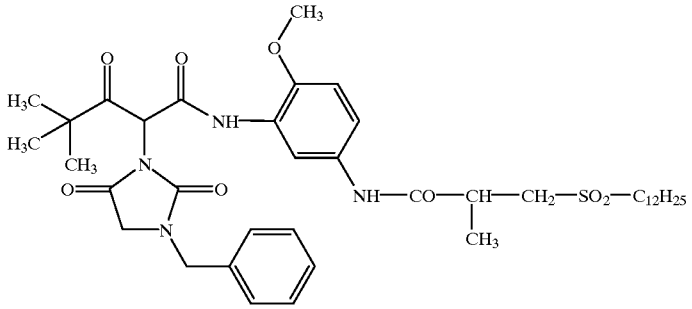
Y-13
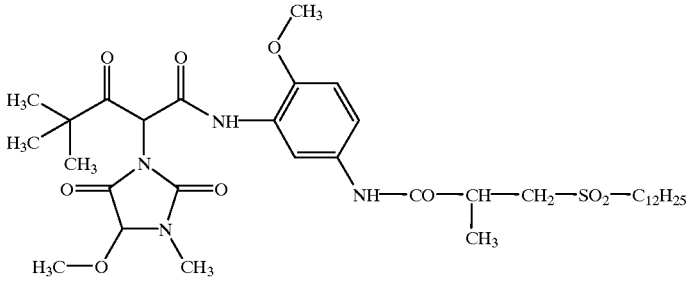
Y-14
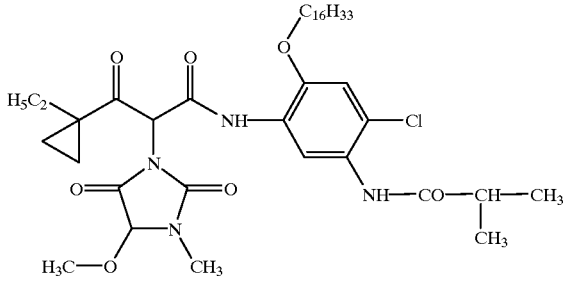
Y-15
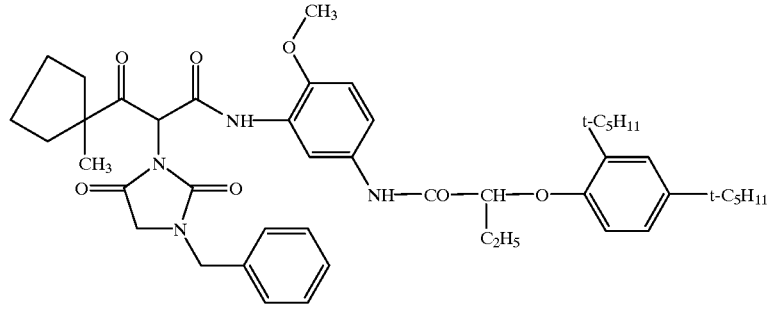

-continued
Y-16
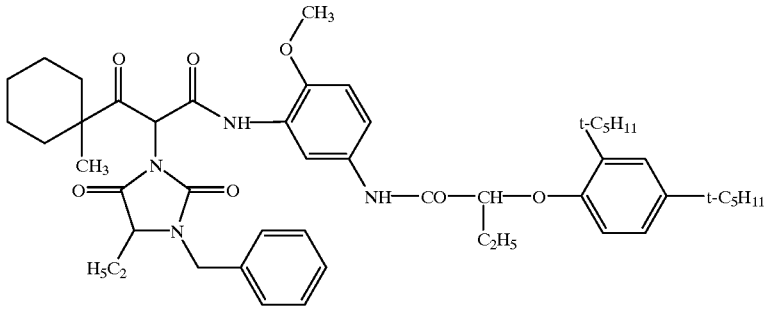
Y-17
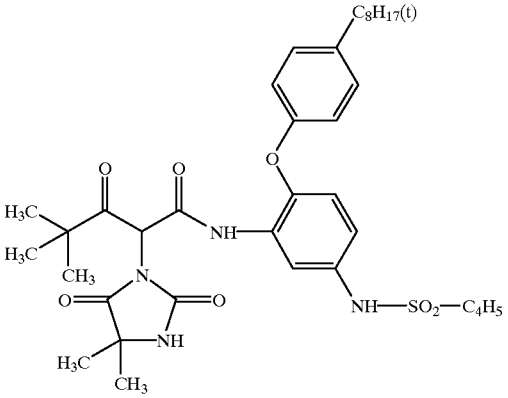
Y-18
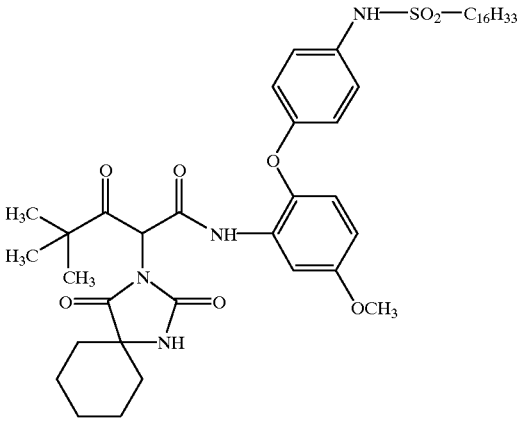
Y-19
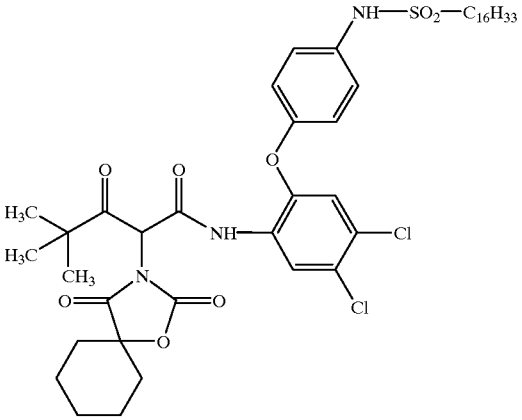
Y-20
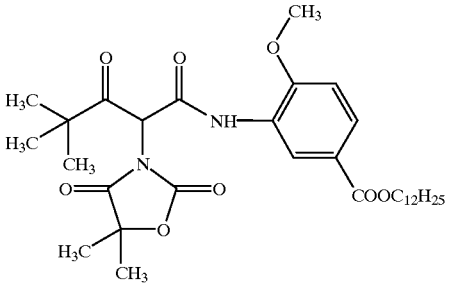
Y-21
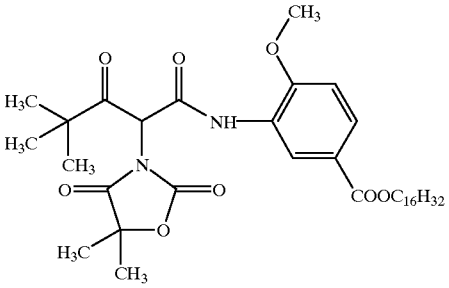
Y-22
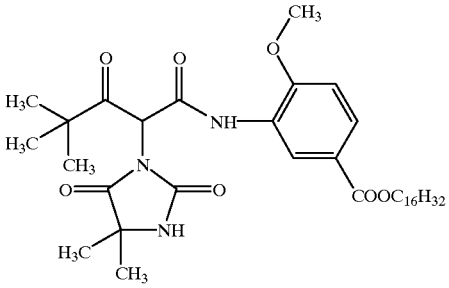

-continued
Y-23
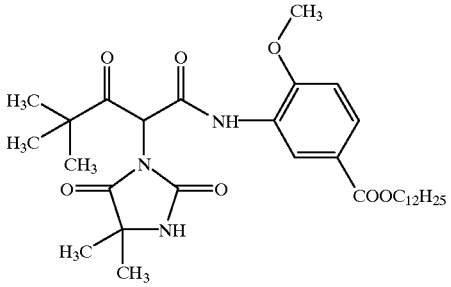
Y-24
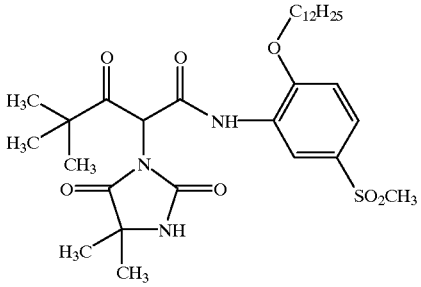
Y-25
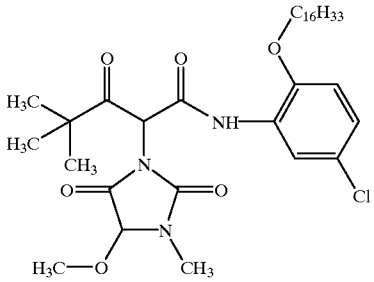
Y-26
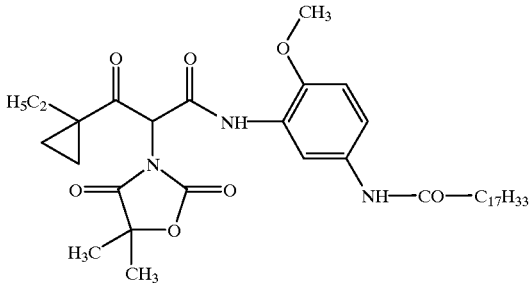
Y-27
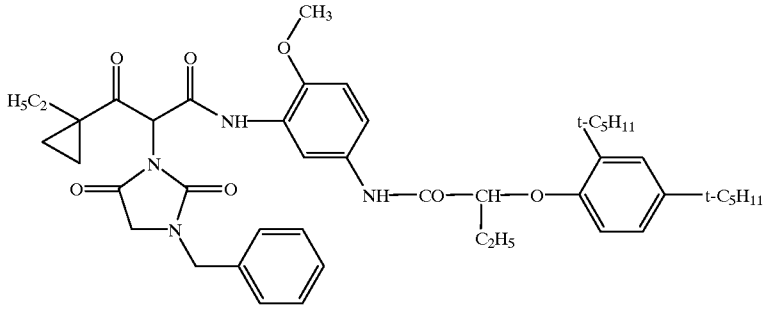
Y-28
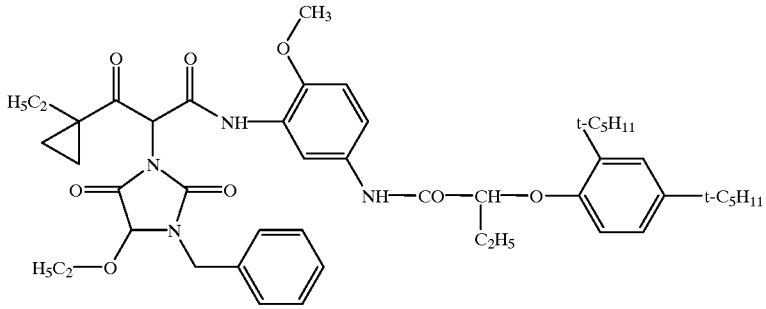
Y-29
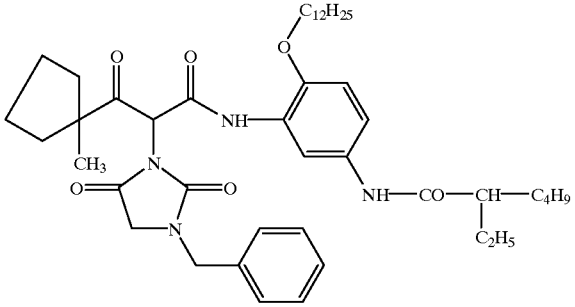

-continued
Y-30
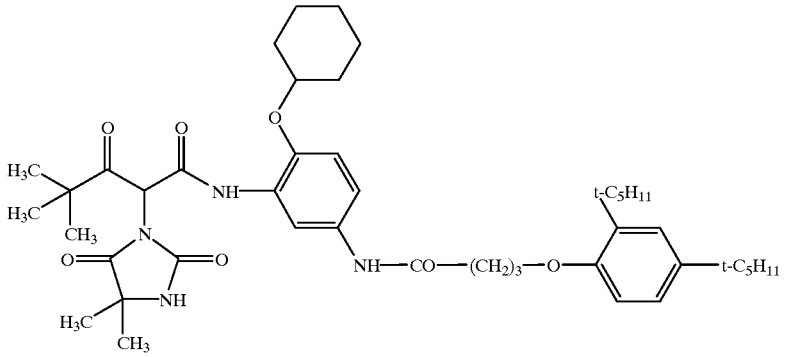
Y-31
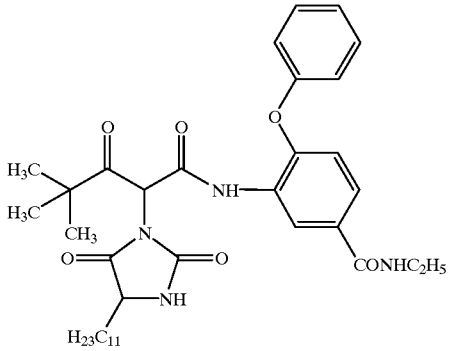
Y-32
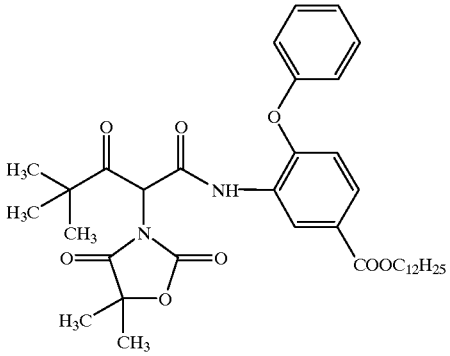
Y-33
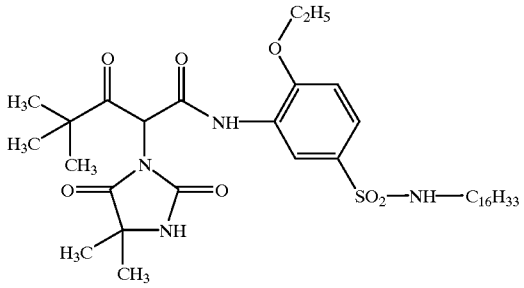
Y-34
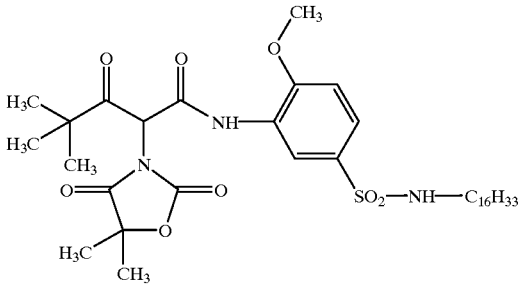
Y-35
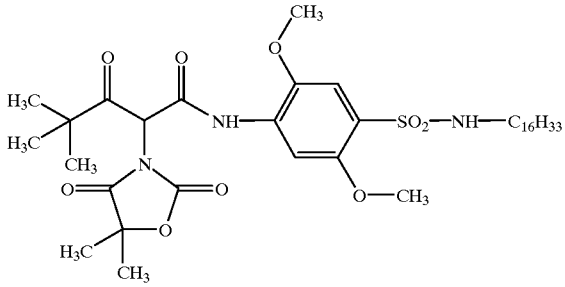

-continued
Y-36
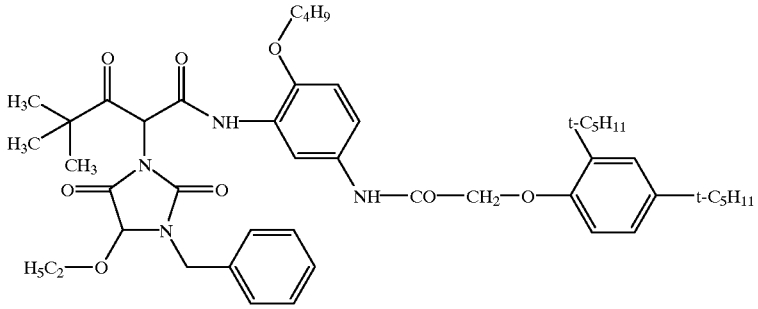
Y-37
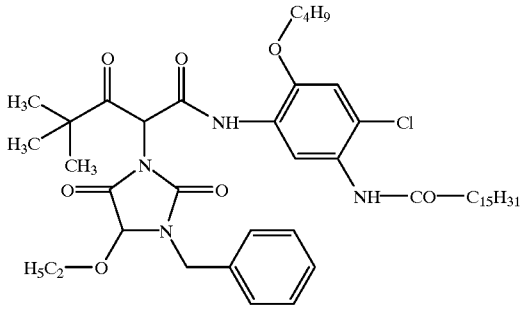
Y-38
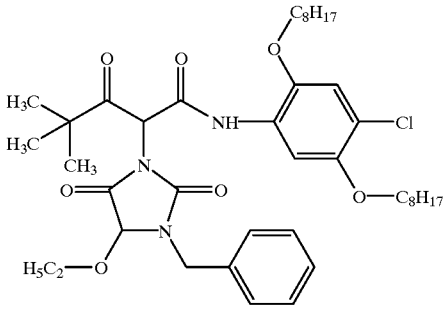
Y-39
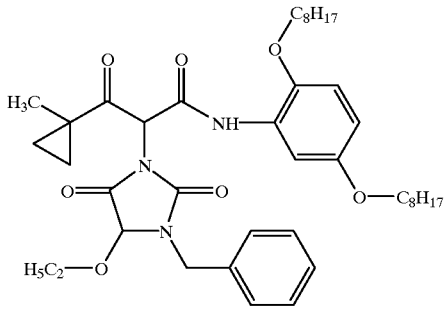
Y-40
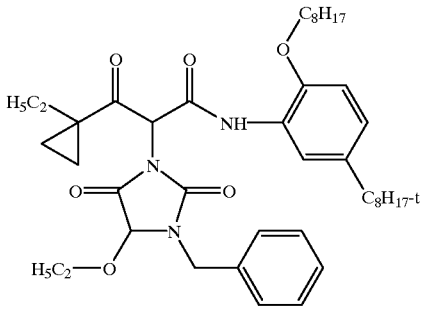
Y-41
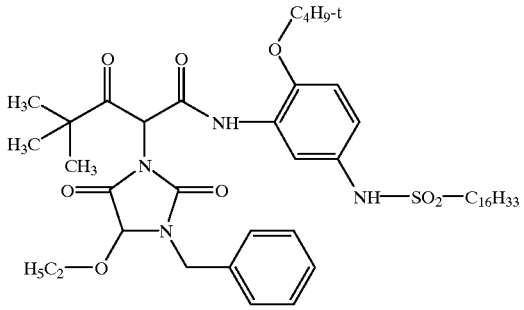
Y-42
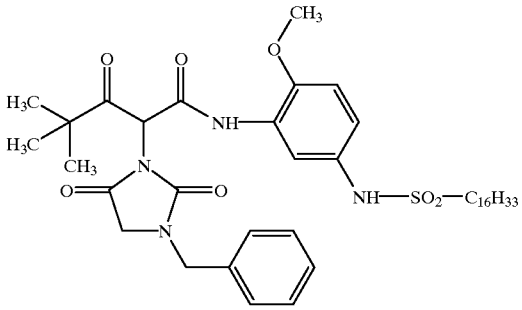
Y-43
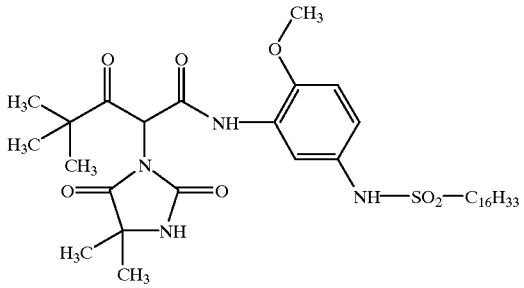

-continued
Y-44
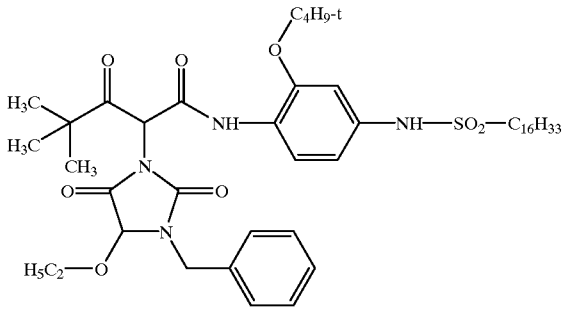
Y-45
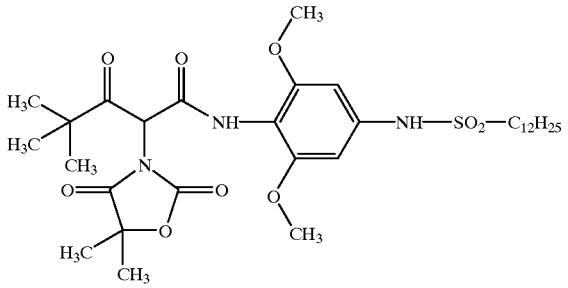
Y-46
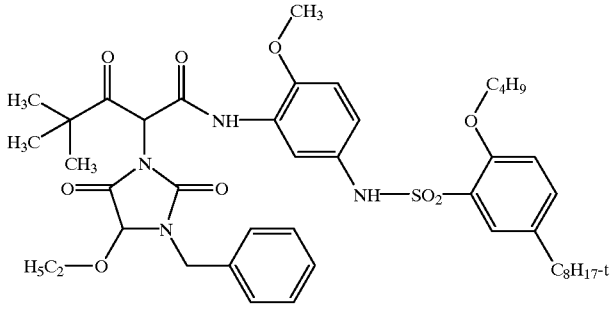
Y-47
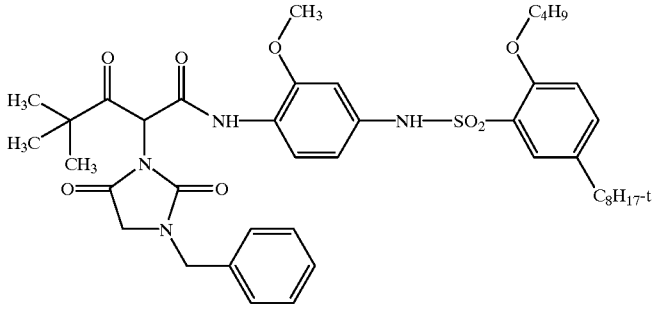
Y-48
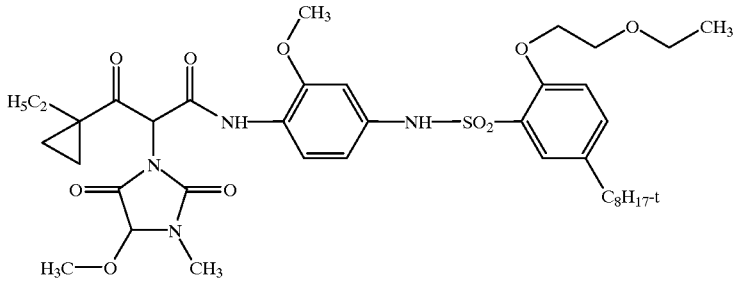

-continued

Y-49

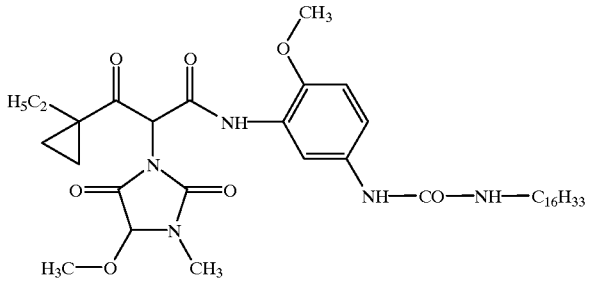

Y-50

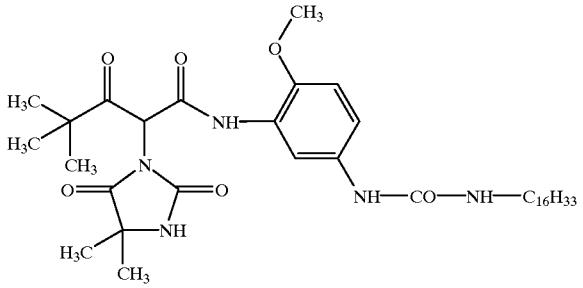

Production of the Silver Halide Emulsion

A: Blue-sensitive emulsions

Emulsion A-1

The following solutions are each prepared with demineralised water:

| | | |
|---|---|---|
| Solution 11 | 1100 g | water |
| | 140 g | gelatine |
| Solution 12 | 1860 g | water |
| | 360 g | NaCl |
| Solution 13 | 1800 g | water |
| | 1000 g | $AgNO_3$ |

Solutions 12 and 13 are simultaneously added at 50° C. over the course of 300 minutes at a pAg of 7.7 to solution 11 with vigorous stirring. A silver chloride emulsion having a mean particle diameter of 0.85 $\mu$m is obtained. The gelatine/$AgNO_3$ weight ratio is 0.14. The emulsion is ultrafiltered, washed and redispersed with a quantity of gelatine such that the gelatine/$AgNO_3$ weight ratio is 0.56. The emulsion is ripened at a pH of 5.3 with an optimum quantity of gold(III) chloride and $Na_2S_2O_3$ at a temperature of 50° C. Once chemically ripened, the emulsion is spectrally sensitised at 50° C. with 1.4 g of compound (AI)/kg of Ag, stabilised with 0.5 g of compound (AII)/kg of Ag and then combined with 0.6 mol. % of KBr (relative to silver nitrate).

AI:

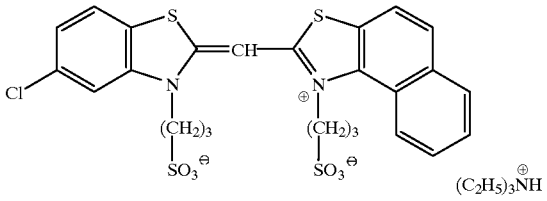

AII:

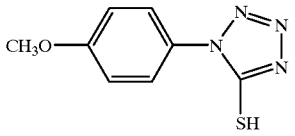

Emulsion A-2: as emulsion A-1, but the emulsion is spectrally sensitised after ripening at 50° C. with 0.732 g of compound (I-1) and 0.749 g of compound (II-1) per kg of Ag instead of 1.4 g of compound AI.

Emulsion A-3: as emulsion A-1, but the emulsion is spectrally sensitised after ripening at 50° C. with 0.975 g of compound (I-1) and 0.500 g of compound (II-1) per kg of Ag instead of 1.4 g of compound AI.

Emulsion A-4: as emulsion A-1, but the emulsion is spectrally sensitised after ripening at 50° C. with 1.098 g of compound (I-1) and 0.375 g of compound (II-1) per kg of Ag instead of 1.4 g of compound AI.

Emulsion A-5: as emulsion A-4, but the precipitation temperature is reduced from 50° C. to 40° C. such that the particle diameter falls from 0.85 $\mu$m to 0.7 $\mu$m. Optimum sensitometry is achieved by using 20 wt. % more gold(III) chloride and $Na_2S_2O_3$ than in emulsion A-4 and 20 wt. % more of compounds (I-1) and (II-1) than in emulsion A-4.

B: Green-sensitive Emulsions

Emulsion B-1

The following solutions are each prepared with demineralised water:

| | | |
|---|---|---|
| Solution 21 | 1000 g | water |
| | 140 g | gelatine |
| Solution 22 | 1650 g | water |
| | 360 g | NaCl |
| | 0.11 mg | $Na_3RhCl_6$ |
| Solution 23 | 1600 g | water |
| | 1000 g | $AgNO_3$ |

Solutions 22 and 23 are simultaneously added at 60° C. over the course of 105 minutes at a pAg of 7.7 to solution 21 with vigorous stirring. A silver chloride emulsion having a mean particle diameter of 0.40 μm is obtained. The gelatine/$AgNO_3$ weight ratio is 0.14. The emulsion is ultrafiltered, washed and redispersed with a quantity of gelatine such that the gelatine/$AgNO_3$ weight ratio is 0.56.

The emulsion is ripened at a pH of 5.3 with an optimum quantity of gold(III) chloride and $Na_2S_2O_3$ at a temperature of 60° C. in 3 hours. Once chemically ripened, the emulsion is spectrally sensitised at 50° C. with 2 g of compound (BI)/kg of Ag and stabilised with 1.0 g of compound (BII)/kg of Ag. 0.3 mol of KBr/mol of $AgNO_3$ are then added.

B-I

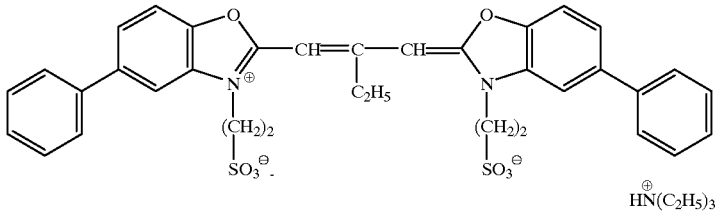

B-II:

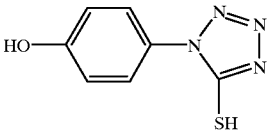

C: Red-sensitive Emulsions

Emulsion C-1

Production proceeds in the same manner as in B-1.

Once chemically ripened, the emulsion is spectrally sensitised at 40° C. with 150 mg of compound (CI)/kcg of Ag and stabilised with 2 g of compound (CII)/kg of Ag. 0.3 mol of KBr/mol of $AgNO_3$ are then added.

C-I:

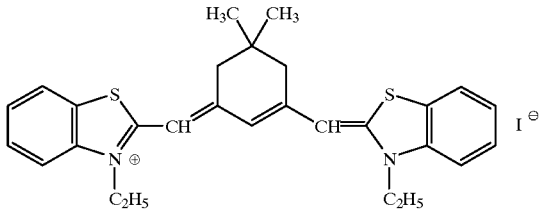

-continued

C-II:

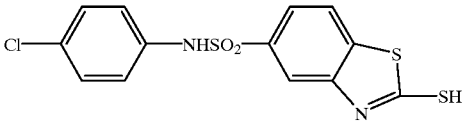

Layer Structure 1

A colour photographic recording material suitable for rapid processing was produced by applying the following layers in the stated order onto a film base made from paper coated on both sides with polyethylene. Quantities are stated per 1 $m^2$. The silver halide application rate is stated as the corresponding quantities of $AgNO_3$.

| | |
|---|---|
| Layer 1: | (Substrate layer) |
| | 0.2 g of gelatine |
| Layer 2: | (Blue-sensitive layer) |
| | Blue-sensitive silver halide emulsion A-1 prepared from |

-continued

| | |
|---|---|
| | 0.40 g of $AgNO_3$ with |
| | 0.96 g of gelatine |
| | 0.55 g of yellow coupler Y-1 |
| | 0.21 g of tricresyl phosphate (TCP) |
| | 0.11 g of dye stabiliser ST-1 |
| Layer 3: | (Protective layer) |
| | 1.02 g of gelatine |
| | 0.05 g of 2,5-di-tert.-octylhydroquinone |
| | 0.10 g of TCP |
| | 0.05 g of compound SC-1 |
| Layer 4: | (Green-sensitive layer) |
| | Green-sensitised silver halide emulsion B-1 prepared from |
| | 0.30 g of $AgNO_3$ with |
| | 0.66 g of gelatine |
| | 0.20 g of magenta coupler PP-1 |
| | 0.10 g of compound SC-1 |
| | 0.25 g of coupler solvent K-1 |
| | 0.05 g of dye stabiliser ST-2 |
| Layer 5: | (Protective layer) |
| | 1.02 g of gelatine |
| | 0.48 g of UV absorber UV-1 |
| | 0.08 g of UV absorber UV-2 |
| | 0.28 g of coupler solvent K-2 |

-continued 0.025 g of 2,5-di-tert.-octylhydroquinone
0.025 g of compound SC-1
0.05 g of TCP Layer 6: (Red-sensitive layer)
Red-sensitised silver halide emulsion C-1 prepared from
0.29 g of $AgNO_3$ with
0.85 g of gelatine
0.41 g of cyan coupler C-1
0.41 g of TCP Layer 7: (Protective layer)

-continued 0.33 g of gelatine
0.15 g of UV absorber UV-1
0.03 g of UV absorber UV-2
0.09 g of coupler solvent K-2

Layer 8: (Protective layer)
0.92 g of gelatine
0.34 g of hardener H-1

The following compounds were used in sample 1:

Y-1

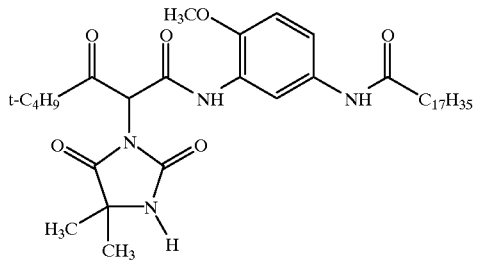

PP-1

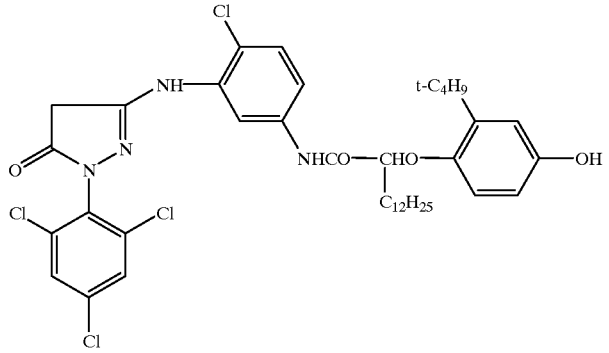

C-1

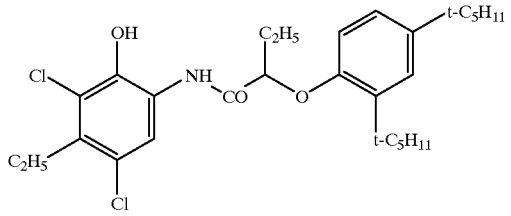

SC-1

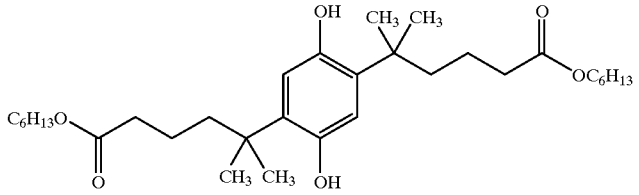

UV-1

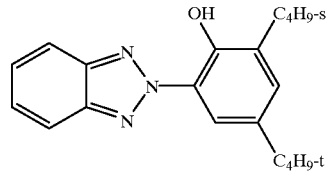

UV-2

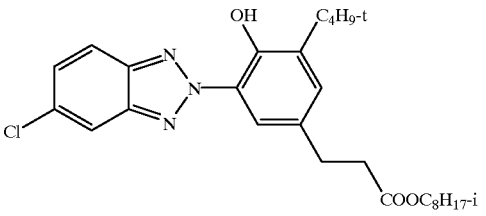

-continued

H-1

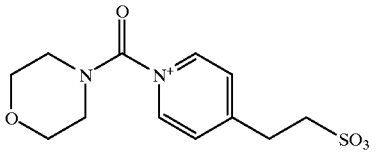

K-1

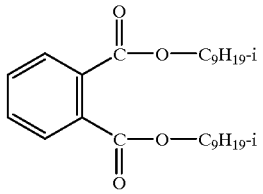

K-2

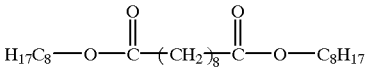

ST-1

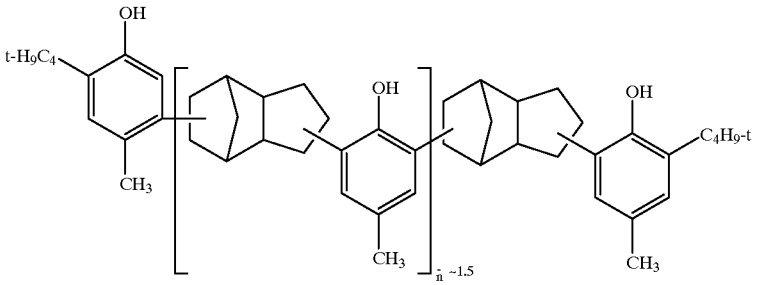

ST-2

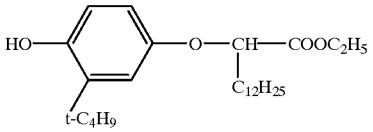

Processing

The specimens were then exposed behind a step wedge for 40 ms and processed as follows using process AP 94:

| a) Colour developer-45s-35° C. | |
|---|---|
| Triethanolamine | 9.0 g |
| N,N-Diethylhydroxylamine | 4.0 g |
| Diethylene glycol | 0.05 g |
| 3-Methyl-4-amino-N-ethyl-N-methanesulfonamidoethyl-aniline sulfate | 5.0 g |
| Potassium sulfite | 0.2 g |
| Triethylene glycol | 0.05 g |
| Potassium carbonate | 22 g |
| Potassium hydroxide | 0.4 g |
| Ethylenediaminetetraacetic acid, disodium salt | 2.2 g |
| Potassium chloride | 2.5 g |
| 1,2-Dihydroxybenzene-3,4,6-trisulfonic acid, trisodium salt | 0.3 g |
| make up to 1000 ml with water; pH 10.0 | |
| b) Bleach/fixing bath-45s-35° C. | |
| Ammonium thiosulfate | 75 g |
| Sodium hydrogen sulfite | 13.5 g |
| Ammonium acetate | 2.0 g |
| Ethylenediaminetetraacetic acid (iron/ammonium salt) | 57 g |
| make up to 1000 ml with water | |
| adjust pH-value with ammonia (25% by weight) or acetic acid to 5.5 | |
| c) Rinsing-2 min-33° C. | |
| d) Drying | |

Layer Structure 2

As layer structure 1, but blue-sensitive emulsion A1 in layer 2 is replaced by A2.

Layer Structure 3

As layer structure 1, but blue-sensitive emulsion A1 in layer 2 is replaced by A3.

Layer Structure 4

As layer structure 1, but blue-sensitive emulsion A1 in layer 2 is replaced by A4.

Layer Structure 5

As layer structure 1, but blue-sensitive emulsion Al in layer 2 is replaced by A5.

Layer Structure 6

As layer structure 2, but layer 4 is of the following composition:

Green-sensitised silver halide emulsion B-1 prepared from 0.20 g of $AgNO_3$ with 1.13 g of gelatine 0.13 g of magenta coupler PP-2

0.05 g of magneta coupler M-6

0.05 g of magenta agenta coupler M-13

0.20 g of dye stabiliser ST-3

0.15 g of dye stabiliser ST-4

0.46 g of coupler solvent K-3

Blue sensitivity log I.t×10 ($E_b$), green sensitivity log I.t×10 ($E_g$) and red sensitivity log I.t×10 ($E_r$), in each case at density 1.0, are determined, as is the difference in sensitivity Δlog I.t×1000 for blue ($\Delta E_b$), green ($\Delta E_g$) and red ($\Delta E_r$) light from the sensitivity on processing 24 h after exposure minus sensitivity on processing 60 seconds after exposure, in each case at density 0.6. The smaller is the value of the difference in sensitivity, the better is the latent image stability.

| Layer structure | Absorption maximum of blue-sensitive layer (nm) | $E_b$ (log I · t × 10) | $E_g$ (log I · t × 10) | $E_r$ (log I · t × 10) | $\Delta E_b$ (Δlog I · t × 1000) | $\Delta E_g$ (Δlog I · t × 1000) | $\Delta E_r$ (Δlog I · t × 1000) | Note |
|---|---|---|---|---|---|---|---|---|
| 1 | 480 | 14.0 | 14.5 | 14.9 | 25 | 15 | 7 | Comparison |
| 2 | 480 | 15.4 | 14.7 | 15.0 | 12 | 17 | 9 | Invention |
| 3 | 478 | 14.9 | 14.7 | 15.1 | 10 | 15 | 5 | Invention |
| 4 | 476 | 14.6 | 14.6 | 14.9 | 7 | 16 | 6 | Invention |
| 5 | 480 | 14.2 | 14.4 | 15.0 | 3 | 11 | 4 | Invention |
| 6 | 480 | 15.4 | 14.7 | 15.0 | 11 | 13 | 8 | Invention |

The silver halide emulsions A2 to A5 sensitised with (I-1) and (II-1) of layer structures 2 to 6 exhibit distinctly higher sensitivity and distinctly better latent image stability.

The higher is the content of compound (1-1), the shorter is the wavelength of the spectral absorption maximum of the blue-sensitive layer.

The greatest latent image stability of the blue-sensitive layer is achieved in layer structure 5 with blue-sensitive emulsion A5 which has a smaller grain size. Sensitivity is nonetheless still greater than in layer structure 1.

Compounds used for the first time in layer structure 6:

PP-2

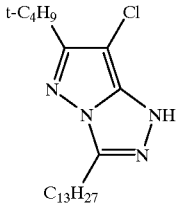

ST-3

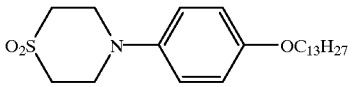

ST-4

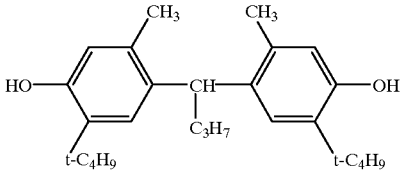

K-3

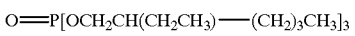

What is claimed is:

1. A color photographic silver halide material which comprises at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler, wherein at least one of the blue-sensitive silver halide emulsions is spectrally sensitized with a mixture of at least one sensitizing dye of the formula (I) and at least one sensitizing dye of the formula (II):

(I)

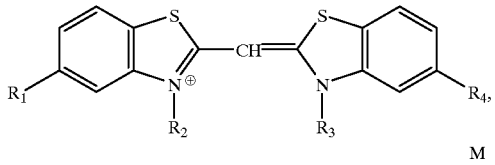

in which $R_1$ is an unsubstituted thienyl, unsubstituted pyrrolyl, unsubstituted furany or unsubstituted phenyl, $R_2$ and $R_3$ mutually independently are alkyl, sulfoalkyl, carboxyalkyl, $—(CH_2)_nCON^{\theta}—COCH_3$, $—(CH_2)_nCON^{\theta}—SO_2CH_3$, $—(CH_2)_nSO_2N^{\theta}—COOH_3$, or $—(CH_2)_nSO_2NHSO_2CH_3$, $R_4$ is H, halogen, benzothienyl or $R_1$ and M is a cation or anion required for charge equalization;

(II)

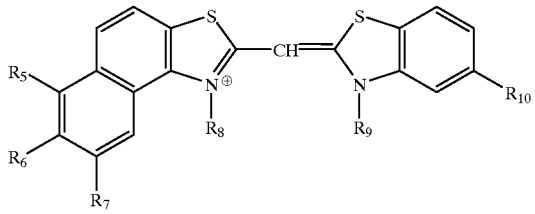

in which $R_5$ and $R_6$ together or $R_6$ and $R_7$ together are the remaining members of a fused benzo ring and the residual substituent $R_5$ or $R_7$which is not part of the fused ring is H and $R_8$ and $R_9$ have the same meaning as $R_2$ and $R_3$, $R_{10}$ is unsubstituted thienyl, unsubstituted pyrrolyl, unsubstituted furanyl or unsubstituted phenyl and M has the above-stated meaning.

2. The color photographic silver halide material according to claim 1, wherein at least 95 mol. % of the silver halide emulsions thereof consist essentially of AgCl.

3. The color photographic silver halide material according to claim 2, wherein there is at most 4 mol. % AgI.

4. The color photographic silver halide material according to claim 3, wherein there is at most 0.5 mol. % AgI.

5. The color photographic silver halide material according to claim 1, wherein the magenta coupler, of which there is at least ones is of the formula (IV)

(IV)

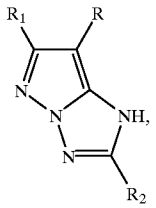

in which

R is H or a group which is eliminated under chromogenic development conditions, $R_1$ is alkyl, $R_2$ is $R_1$ or aryl, and wherein the sum of all the C atoms of residues $R_1$ and $R_2$ in a coupler molecule is at least 12.

6. The color photographic silver halide material according to claim 5, wherein the material contains at least one yellow coupler of the formula (Ill)

(III)

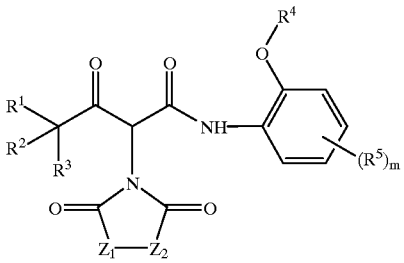

in which $R^1$, $R_2$ and $R^3$ mutually independently are alkyl or $R^2$ and $R^3$ together form a carbocyclic three- to six-membered ring;

$R^4$ is alkyl, cycloalkyl or aryl;

$R^5$ is halogen, alkyl, alkoxy, aryloxy, alkoxycarbonyl, alkylsulfonyl, alkylcarbamoyl, arylcarbamoyl, alkylsulfamoyl or arylsulfamoyl;

m is 0, 1, 2 or 3;

$Z_1$ —O— or —$NR^6$—;

$Z_2$ is —$NR^7$— or —$C(R^8)R^9$—;

$R^6$, $R^7$, $R^8$ and $R^9$ mutually independently are hydrogen, methyl, ethyl, butyl, methoxy, ethoxy, phenyl, —$CH_2$ phenyl or $C_{11}H_{23}$.

7. The color photographic silver halide material according to claim 6, wherein $R_6$, $R_7$, $R_8$ and $R_9$ mutually independently are hydrogen, methyl, butyl, or ethyl.

8. The color photographic silver halide material according to claim 6, where $R^1$, $R^2$ and $R^3$ are alkyl.

9. The color photographic silver halide material according to claim 1, wherein the compounds of the formulas (I) and (II) are used in a quantity of 0.025 g to 2.5 g per mol of silver halide.

10. The color photographic silver halide material as claimed in claim 1, wherein said color photographic silver halide material is a print material.

11. The color photographic silver halide material according to claim 1, wherein the yellow coupler, of which there is at least one, is of the formula (III)

(III)

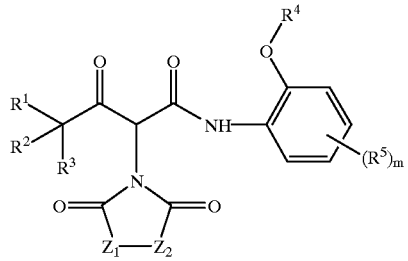

which $R^1$, $R^2$ and $R^3$ mutually independently are alkyl or $R^2$ and $R^3$ together form a carbocyclic three- to six-membered ring;

$R^4$ is alkyl, cycloalkyl or aryl;

$R^5$ is halogen, alkyl, alkoxy, aryloxy, alkoxycarbonyl, alkylsulfonyl, alkylcarbamoyl, arylcarbamoyl, alkylsulfamoyl or arylsulfamoyl;

m is 0, 1, 2 or 3;

$Z_1$ is —O— or —$NR^6$—, $Z_2$ is —$NR^7$— or —$C(R^8)R^9$—;

$R^6$, $R^7$, $R^8$ and $R^9$ mutually independently are hydrogen, methyl, ethyl, butyl, methoxy, ethoxy, phenyl, —$CH_2$ phenyl or $C_{11}H_{23}$.

* * * * *

UNITED STATES PATENT AND TRADEMARK OFFICE

CERTIFICATE OF CORRECTION

PATENT NO. : 6,171,776 B1
DATED : January 9, 2001
INVENTOR(S) : Cuong Ly et al.

It is certified that error appears in the above-identified patent and that said Letters Patent is hereby corrected as shown below:

Column 38, claim 1,
Line 33, (line 6 after formula) "$-(CH_2)_nSO_2N^{\theta}-COOH_3$". should read -- $-(CH_2)_nSO_2N^{\theta}-COCH_3$ --.

Column 39,
Line 41, (claim 6, line 2 after formula) "$R_2$" should read -- $R^2$ --.

Signed and Sealed this

Sixth Day of November, 2001

*Attest:*

Nicholas P. Godici

NICHOLAS P. GODICI
*Acting Director of the United States Patent and Trademark Office*

*Attesting Officer*